United States Patent [19]

Kawamura et al.

[11] Patent Number: 5,074,768

[45] Date of Patent: Dec. 24, 1991

[54] PISTON COMPRESSOR

[75] Inventors: Hisato Kawamura; Hayato Ikeda; Satoshi Umemura; Masakazu Ohbayashi, all of Kariya, Japan

[73] Assignee: Kabushiki Kaisha Toyoda Jidoshokki Seisakusho, Kariya, Japan

[21] Appl. No.: 678,521

[22] Filed: Mar. 28, 1991

[30] Foreign Application Priority Data

Apr. 2, 1990 [JP] Japan ..... 2-35651[U]

[51] Int. Cl.[5] ..... F04B 39/10

[52] U.S. Cl. ..... 417/571; 137/512.15

[58] Field of Search ..... 137/855, 856, 857, 858, 137/512.15; 417/570, 571, 269

[56] References Cited

U.S. PATENT DOCUMENTS

| | | | |
|---|---|---|---|
| 2,151,746 | 3/1939 | Cody | 137/856 |
| 4,911,614 | 3/1990 | Kawai et al. | 137/856 |
| 4,976,284 | 12/1990 | Hovarter | 137/856 |

*Primary Examiner*—Richard A. Bertsch

*Assistant Examiner*—Charles G. Freay

*Attorney, Agent, or Firm*—Brooks Haidt Haffner & Delahunty

[57] ABSTRACT

A piston compressor having cylinder blocks, each defining cylinder bores in which a piston is axially reciprocally arranged. Front and rear housings are connected to the cylinder blocks via valve port plates, so that compression chambers are formed between the valve port plates and the cylinder blocks and inlet and outlet chambers are formed between the valve port plates. The valve port plates form inlet and outlet ports for each of the compression chambers and inlet valves and outlet valves formed as thin resilient web members are provided for the inlet and outlet ports, respectively, to control the feeding and discharge of the gas, respectively. The valve port plates having, on the surfaces thereof facing the outlet valve around the inlet ports, a roughened area having a surface roughness value $\overline{R}_z$ of between 10 to 25 μm and an average spacing value $\overline{L}$ of between to 50 to 100 μm.

3 Claims, 7 Drawing Sheets

PISTON COMPRESSOR

BACKGROUND OF THE INVENTION

1. Field of the Invention

The present invention relates to a construction of a piston compressor by which an operating noise thereof is reduced.

2. Description of the Related Art

Known in the prior art is a piston compressor of a type provided with cylinder blocks having cylinder bores, inlet and outlet ports, pistons reciprocally and slidable arranged in the respective cylinder bores, compression chambers formed on sides of the respective pistons, valve port plates forming inlet and outlet ports, and inlet and outlet valves made of thin metal web for controlling the admission of gas via the inlet ports into the compression chambers and a discharge of the gas via the outlet ports from the compression chambers, respectively.

In this type of the compressor, the pistons are connected to a means such as a swash plate, to obtain a reciprocating movement of each of the pistons between axially spaced first and second positions (dead centers positions), and as a result, during one complete rotation of the swash plate, the movement of the piston in one direction toward first dead center position at which the volume of the compression chamber is increased allows the gas to be introduced into the compression chambers via the inlet valves, and the movement of the piston in the opposite direction toward the second dead center position at which the volume of the compression chamber is reduced allows the gas to be discharged from the compression chambers via the outlet valves. In this type of compressor, the piston must be located as near as possible to the valve port plates to obtain as small as possible a clearance between the piston and the valve plates when the piston is at the second dead center position, while preventing the piston from coming into contact with valve port plates within a permissible tolerance of the clearance between the pistons and the valve plates and the valve port plates when assembled, whereby an increased compression efficiency is obtained.

However, the increase in the compression efficiency by reducing the clearance between the pistons and the valve plates to a permissible limit, even if within a range of tolerance, can generate an "over compression" phenomenon whereby the pressure in the compression chamber becomes much higher the discharged gas pressure at the outlet chambers, which subjects the peripheral units to an excessive pressure and often causes damage thereto, and further, causes a generation of noise because the outlet valve is brought into violent contact with the retainer plates thereof. Such an over compression is due to the existence of the lubricant mist in the gas to be compressed. Namely, when a thin metal web outlet valve is at a position at which it closes the outlet port, lubricant held between the outlet valves and valve port plate generates an adhesive force therebetween, and as a result, the outlet valves are adhered to the valve port plate. In the prior art, this force becomes relatively large because the valve port plate has a very smooth surface on the order of 1.6 to 3.2 μmRz, needed to maintain a desired sealing between the outlet valves to the valve port plates and to obtain a desired sealing of the compression chambers. The large adhesive force between the outlet valve and the valve port plate causes difficulties in separating the outlet valve from the valve port plate, causing the pressure in the compression chambers to become much higher than the pressure at the outlet port, whereby an over compression occurs.

SUMMARY OF THE INVENTION

An object of the present invention is to reduce the noise in a piston compressor without lowering the compression efficiency thereof.

Accordingly, the present invention provides a compressor comprising:

an axially extending drive shaft;

a pair of axially spaced apart means for rotatably supporting the drive shaft;

a cylinder block defining therein angularly spaced apart, axially extending cylinder bores;

pistons axially and slidably arranged in the respective cylinder bores;

means for mechanically connecting the drive shaft with the pistons so that the rotational movement of the drive shaft is transformed into an axial reciprocating movement of the pistons;

at least one valve port plate axially spaced apart and forming parallel first and second surfaces extending transverse to the axis of the drive shaft, the valve port plate being arranged on one side of the cylinder block so that compression chambers are formed between the respective pistons and the valve port plate in such a manner that the volumes of the compression chambers are changed by the reciprocation of the respective pistons in the respective cylinder bores;

the valve port plate defining an inlet port and an outlet port for each respective compression chambers;

an inlet chamber and outlet chamber on the side of the valve port plate remote from the pistons, the inlet chamber and the outlet chamber being separated from each other, the inlet chamber receiving gas to be compressed, via the respective inlet ports, and the outlet chamber discharging the compressed gas via the respective outlet ports;

inlet valves formed as a thin resilient web member arranged on the side of the valve port plate adjacent to the respective pistons, the inlet valves being urged under their own resiliency toward the respective positions at which they are in contact with the faced surface of the valve port plate, to thereby close the respective inlet ports, the inlet valve being deflected from said closed position by a lowering of the pressure in the respective compression chambers, to thereby allow the gas to be compressed to be fed from the inlet chamber to the respective compression chambers, and;

outlet valves formed as a thin resilient web member arranged on the opposite side of the valve port plate remote from the respective pistons, the outlet valves being urged under their own resiliency toward the respective positions at which they are in contact with the faced surface of the valve port plate to thereby close the respective outlet ports, the outlet valve being deflected from said closed position by an increase of the pressure in the respective compression chambers, to thereby allow the compressed gas to be discharged from the respective compression chambers to the outlet chamber;

the valve port plate having roughened areas on the surface facing the outlet valves around the respective outlet ports, said roughened areas having a surface roughness value $\overline{R}_z$ of between 10 μm and 25 μm, and having an average spacing value $\overline{L}$ of between 50 μm and 100 μm.

The provision of the roughened areas having the above-mentioned degree of roughness on the surface of the valve port plate facing the outlet valves around the respective outlet ports reduces the adhesive force between the outlet valves and the valve port plate, to thereby suppress an overcompression and thus reduce noise in the compressor without lowering the compression efficiency thereof.

BRIEF DESCRIPTION OF THE DRAWINGS

FIG. 5-b shows the relationships between the average spacing and the noise level of the compressor;

FIG. 6-b shows the relationships between the surface roughness and the noise level of the compressor;

FIG. 7-(b) shows the operation of the outlet valve during one complete cycle of the compressor operation;

FIG. 7-(c) shows the operation of the inlet valve during one complete cycle of the compressor operation.

DESCRIPTION OF THE PREFERRED EMBODIMENTS

Figure 1:
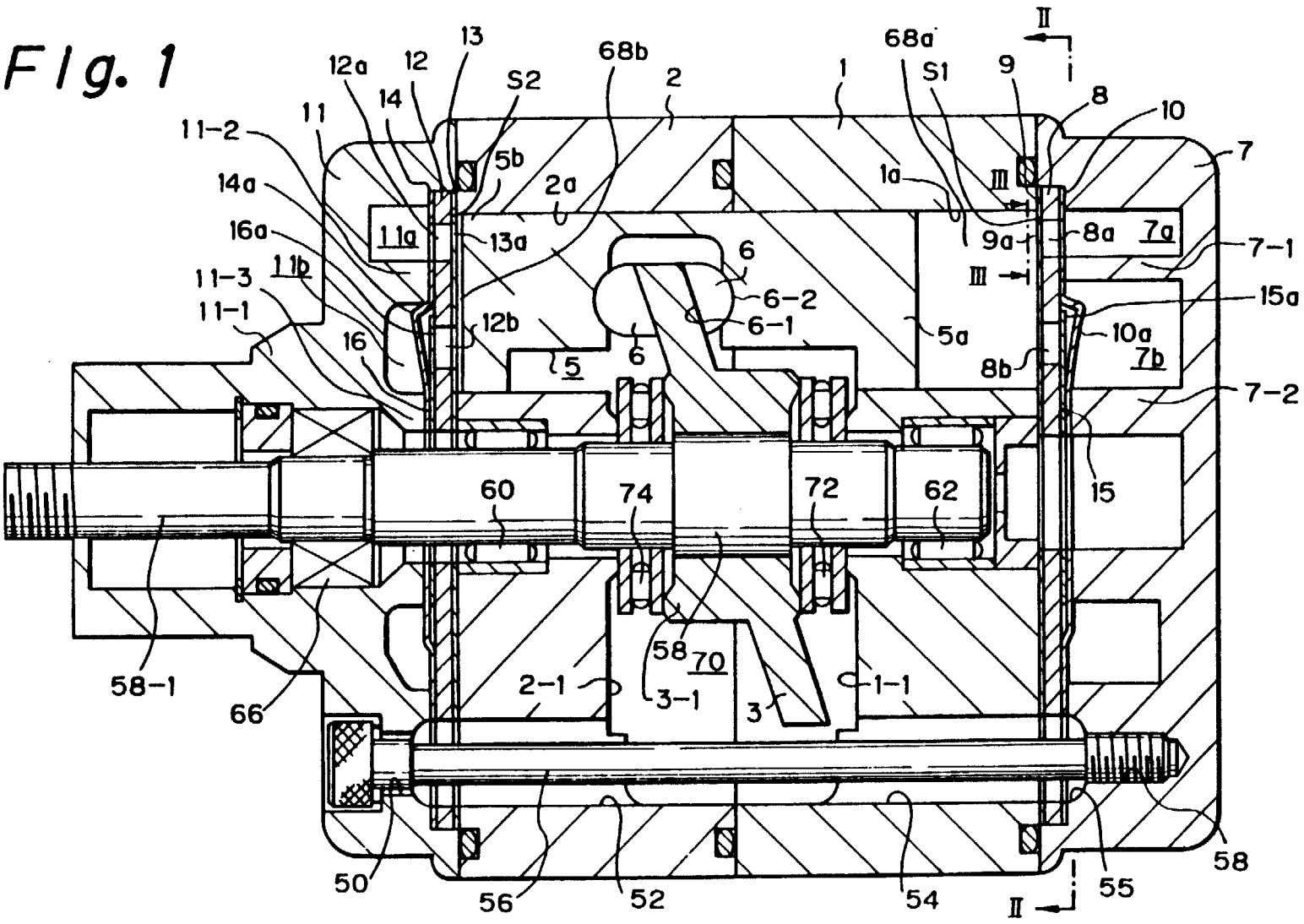
FIG. 1 is a cross sectional view of the compressor according to the present invention taken along the axial direction thereof.

As shown in FIG. 1, the compressor is provided with a pair of axially separated cylinder blocks 1 and 2 arranged between front and rear housings 11 and 7. The housings 11 and 7 and the cylinder blocks 2 and 1 are provided with angularly spaced, aligned bores 50, 52, 54, and 55, to which bolts 56 are freely inserted, and the housing 7 is provided with aligned threaded bores 57 in which the respective bolts 56 are screwed, whereby the cylinder blocks 1 and 2 and the housings 7 and 11 are fixedly connected to each other.

A shaft 58 is mounted concentric to the cylinder blocks 1 and rotatably supported therein by axially spaced apart, radial needle bearing assembles 60 and 62. One end 58-1 of the shaft 58 extends outside the front housing 11 at the boss portion 11-1 thereof, and is connected to a not shown drive means such as a crankshaft of an internal combustion engine, to thereby transmit a rotation of the drive means to the drive shaft 58. A seal member 66 is arranged inside the boss portion 11-1, to thus allow the drive shaft 58 to be rotated while sealing the space inside the compressor.

The cylinder blocks 1 and 2 are provided with five pairs of equiangularily spaced and aligned cylinder bores 1a and 2a extending axially therethrough, and a double-headed piston 5 is slidably arranged in each of the paired aligned cylinder bores 1a and 2a, so that the piston 5 is slidably moveable parallel to the longitudinal axis of the shaft 58, between axially spaced apart dead center positions thereof. Compression chambers 68a and 68b are formed on the axially spaced ends 5a and 5b of each of the pistons 5 in the respective cylinder bores 1a and 2a, respectively.

The cylinder blocks 1 and 2 define axially opposed recess 1-1 and 2-1, to thereby create a space 70 between the cylinder blocks 1 and 2, and a swash plate 3 is arranged in the space 70. The drive shaft 58 is fixedly connected to a boss portion 3-1 of the swash plate 3 in such a manner that the rotation of the drive shaft 58 causes a rotation of the swash plate 3 in the space 70. Thrust needle bearing assemblies 72 and 74 are arranged between the boss portion 3-1 of the swash plate 3 and the cylinder block 1, and the boss portion 3-1 and the cylinder block 2, respectively. The swash plate 3 is connected at the periphery thereof to the pistons 5, via respective pairs of shoes 6. The shoes 6 in each pair thereof are provided with opposite flat parallel surfaces 6-1 which are slidable with respect to the opposed surface of the swash plate 3, and semi-spherical surfaces 6-2 which are slidable with respect to the opposed semi-spherical recess in the pistons 5, and as a result, the rotation of the swash plate 3 causes an axial reciprocation of the pistons 5 in the respective pairs of cylinder bores 1a and 2a.

Figure 2:
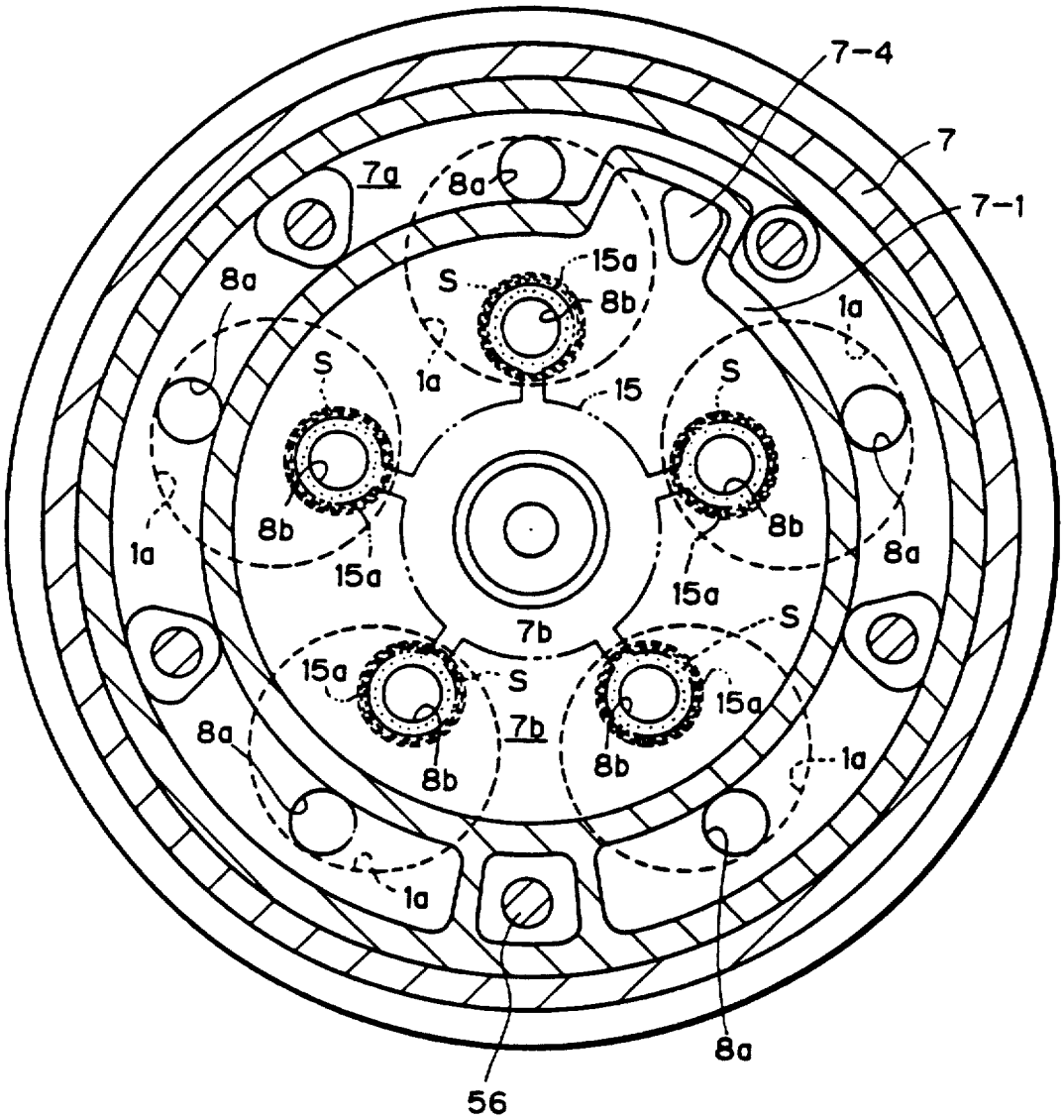
FIG. 2 is a cross sectional view taken along the line II—II in FIG. 1.
Figure 3:
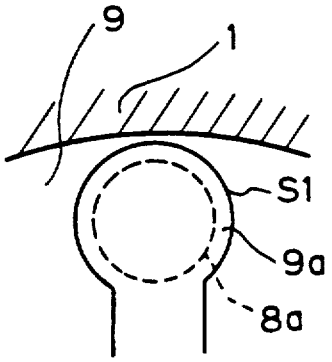
FIG. 3 is a view taken along the line III—III in FIG. 1.

A valve port plate 8 is extended transversely with respect to the axis of the drive shaft 58 and is fixed between the cylinder block 1 and the rear housing 7, an inner valve forming plate 9 made of a resilient thin metal web is fixedly arranged between the valve port plate 8 and the cylinder block 1, and a valve retainer forming plate 10 is fixedly arranged between the valve port plate 8 and the rear housing 7. Further, an outer valve forming plate 15 made of a thin resilient web is arranged between the valve port plate 8 and the valve retainer forming plate 10. At respective angular positions in the corresponding compression chambers 68a, the valve port plate 8 forms inlet ports 8a and outlet ports 8b, the valve forming plate 9 forms equiangularily spaced inlet valve portions 9a, and the valve forming plate 15 forms equiangularily spaced outlet valve portion 15a. The inlet and outlet valves 9a and 15a are urged under their own resiliency into contact with the valve port plate 8 to close the inlet and outlet ports 8a and 8b, respectively. The rear housing 7 forms an outer partition wall 7-1 and inner partition wall 7-2 projected axially toward the valve port plate 8 such that the walls 7-1 and 7-2 are in contact with the retainer plate 15, whereby an annular inlet chamber 7a is formed in the rear housing 7 outside the partition wall 7-1, and an annular outlet chamber 7b is formed in the rear housing 7 inside the partition wall 7-1. The inlet chamber 7a is connected to the compression chambers 68a via the respective inlet ports 8a when the respective inlet valve 9a are opened, and the compression chambers 68a is connected to the outlet chamber 7b via the respective outlet ports 8b when the respective outlet valves 15a are opened. Behind the outlet valves portions 15a, the retainer plate 10 forms partially raised portions as retainers 10a which prevent a buckling of the respective outlet valves 15a. Note, the valve forming plate 9 is provided with slits S1 (FIG. 3) forming the valve portions 9a, which usually close the outlet ports 8b, and are displaced by the reduction in the pressure in the compression chambers 68a, to thus allow the gas from the inlet chamber 7a to be compressed. As will be seen from FIG. 2, the valve portions 15b are integrally formed and extend radially from a central annular portion. As also shown in FIG. 2, the housing 7 is provided with a discharge port 7-4 for discharging the compressed gas to a user device, such as an air conditioning system for a vehicle.

A valve port plate 12 extends transversely with respect to the axis of the driving shaft 58 and is fixed between the cylinder block 2 and the front housing 11, an inner valve forming plate 13 is fixedly arranged between the inner side of the valve port plate 12 and the cylinder block 2, and a valve retainer forming plate 14 is fixedly arranged between the outer side of the valve port plate 12 and the front housing 11. Further, an outer valve forming plate 16 is arranged between the valve port plate 12 and the retainer forming plate 14. At respective angular positions in the corresponding compression chambers 68b, the valve port plate 12 forms inlet ports 12a and outlet ports 12b, the valve forming plate 13 forms inlet valve portions 13a, and the valve forming plate 16 forms outlet valve portion 16a. The front housing 11 forms an outer partition wall 11-2 and inner partition wall 11-3 projected axially toward the valve port plate 12 such that the walls 11-2 and 11-3 are in contact with the retainer plate 14, whereby an annular inlet chamber 11a is formed in the front housing 11 outside the partition wall 11-2, and an annular outlet chamber 11b is formed in the front housing 11 inside the partition wall 11-2. The inlet chamber 11a is connected to the compression chambers 68b via the respective inlet ports 12a when the respective inlet valve 13a are opened, and the compression chambers 68b is connected to the outlet chamber 11b via the respective outlet ports 12b when the respective outlet valves 16a are opened. Behind the outlet valves portions 16a, the retainer plate 14 forms retainers 14a which prevent a buckling of the respective outlet valves 16a. Note, the valve forming plate 13 is provided with slits S2 forming the valve portions 13a.

The rotation of the swash plate 3 by the rotation of the drive shaft 58 causes an axial reciprocation of the double-headed piston 5. Therefore, when the pistons 5 move to the left in FIG. 1, the volume of the respective chambers 68a on the side of the piston ends 5a is increased and the pressure in the corresponding chambers 68a is decreased, whereby the corresponding inlet valves 9a are opened and outlet valves 15a are closed, and as a result, the gas to be compressed is fed from the inlet chamber 7a into the chambers 68a via the corresponding inlet ports 8a. At the same time, the leftward movement of the pistons 5 causes the volume of the corresponding chambers 68b at the opposite piston ends 5b to be decreased and the pressure in the corresponding chambers 68b to be increased, whereby the corresponding outlet valves 16a are opened and the inlet valves 13a are closed, and as a result, the compressed gas in the chamber 68b is discharged into the outlet chamber 11b via the corresponding outlet ports 12b.

Conversely, when the pistons 5 move to the right in FIG. 1, the volume of the respective chambers 68a at the piston ends 5a is reduced and the pressure in the corresponding chambers 68a is increased, whereby the corresponding outlet valves 15a are opened and the inlet valves 9a are closed, and as a result, the compressed gas in the compression chambers 68a is discharged into the outlet chamber 7b via the corresponding outlet ports 8b. At the same time, the rightward movement of the pistons 5 causes the volume of the corresponding chambers 68b on the opposite piston ends 5b to be increased and the pressure in the corresponding chambers 68b to be decreased, whereby the corresponding inlet valves 13a are opened and outlet valves 16a are closed, and as a result, the gas in the chamber 11a to be compressed is introduced into the corresponding compression chambers 68b via the corresponding inlet ports 12a.

Figure 4:
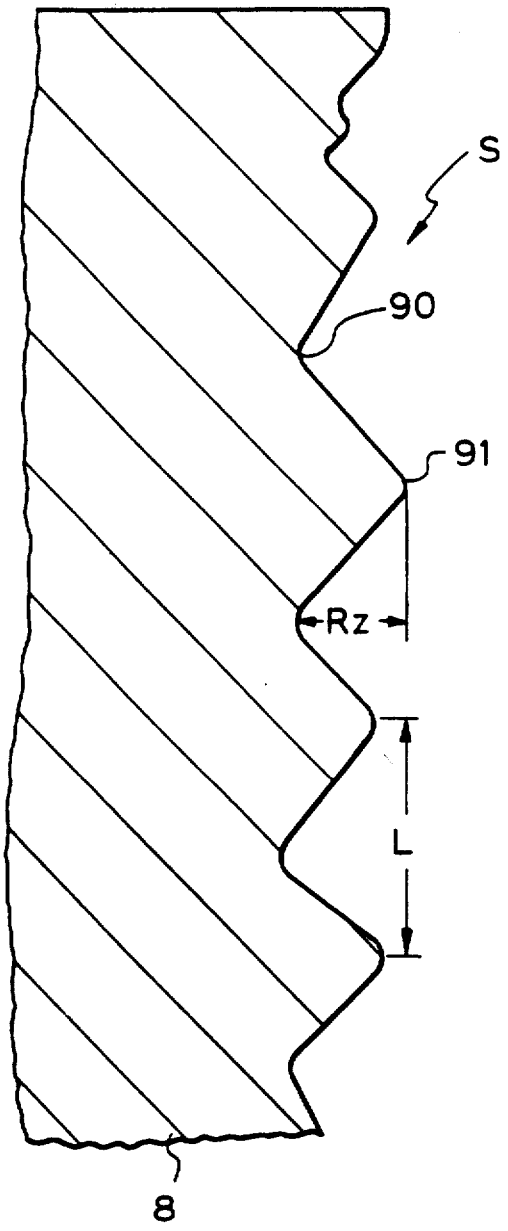
FIG. 4 shows a cross sectional profile of the roughened area around an outlet port on the valve port plate.

According to the present invention, as shown in FIG. 2, the valve port plate 8 has annular roughened surface area S around the edges of the respective outlet ports 8b, at the surface of the plate 8 facing the respective outlet valves 15a. These roughened surface areas are preferably obtained by a shot blasting process. Similarly, the valve port plate 12 has annular roughened surface areas around the edges of the respective outlet ports 12b facing the respective outlet valves 16a. A cross sectional profile of the roughened areas S is schematically shown in FIG. 4 on an enlarged scale. The roughened surface area S is formed by alternately recessed portions 90 and projected portions 91. A depth of the recess 90 with respect to the adjacent projection 91 is expressed by $R_z$, and the average value $\overline{R}_z$ will be referred to in this specification as the surface roughness. Furthermore, the average value $\overline{L}$ of a distance L between the adjacent projections 91 is an important parameter of the roughened surface areas S.

The gas to be compressed includes a lubricant for the lubrication of sliding portions of the compressor. This lubricant passes between the outlet valve forming plate 15 and the valve port plate 8, and between the outlet valve forming plate 16 and the valve port plate 12, and often generates an adhesive force under the surface tension thereof, which force opposes the separation of the outlet valves 15a and 16a from the respective valve port plates 8 and 12, and accordingly the above mentioned over compression can occur. The provision of the roughened areas S prevents the occurrence of this over compression. Namely, the larger the degree of surface roughness thereof, the easier it becomes to introduced the gas into the gap between the valve port plate 8 and the valve forming plate 15 or between the valve port plate 12 and valve forming plate 16, by which the adhesion force therebetween is reduced.

The roughened surface areas S according to the present invention, in addition to the $\overline{R}_z$ as explained above, are further characterized by a mean value $\overline{L}$ of the values of the distances L between the adjacent projections 91. As will be understood, the longer the mean distance $\overline{L}$, the easier it becomes to introduce the gas into the gap between the valve port plate 8 and the valve forming plate 15 or between the valve port plate 12 and valve forming plate 16, where the valve forming plates 15 and 16 are adhered to the corresponding valve port plates 8 and 12 due to the existence of the lubricant therebetween.

As mentioned above, the roughened area S can be obtained by a shot blasting process, whereby fine particles are shot from a gun toward the surface to be treated by a force of compressed air. A kinematic energy of the particles, i.e., the speed of the flow of compressed air, can be controlled to thereby obtain a desired value of the surface roughness $\overline{R}_z$. Further, the shape of the particles can be varied to obtain a desired value of the average spacing $\bar{L}$. For example, the fine particles having a rod shape can be used to obtain a large average value of the spacing $\bar{L}$. Conversely, fine particles having an angular shape can be used to obtain a small value of the spacing $\bar{L}$.

Figure 5A:
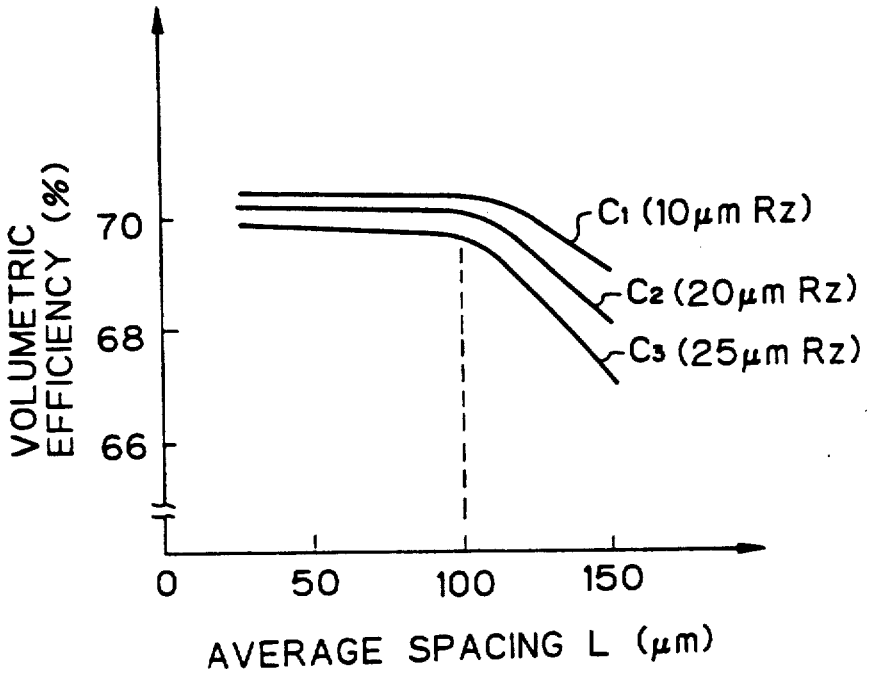
FIG. 5-a shows the relationships between the average spacing and the volumetric efficiency.
Figure 5B:
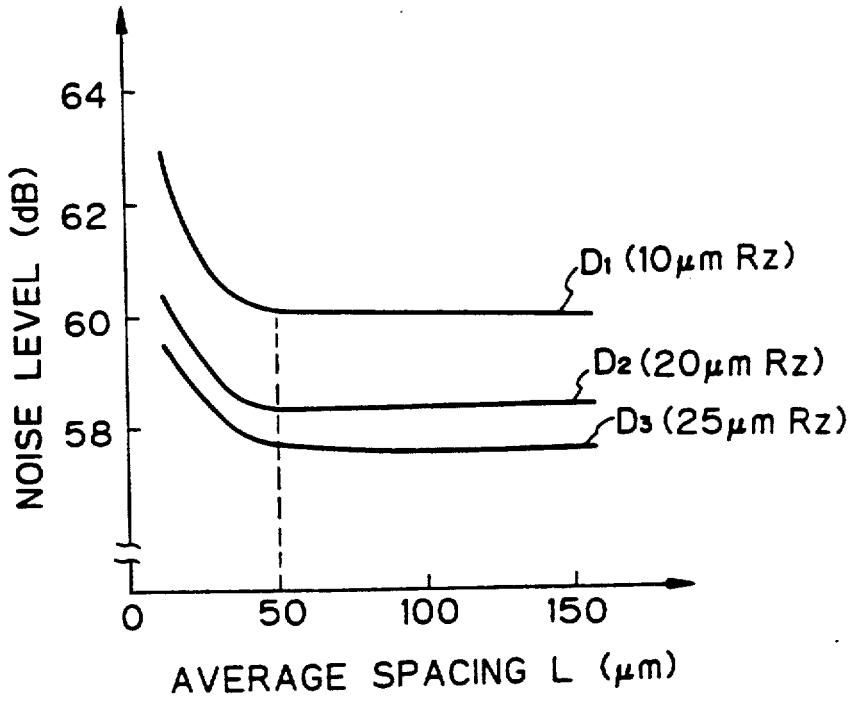

FIG. 5-a shows the relationships $C_1$, $C_2$, and $C_3$ between the average spacing $\bar{L}$ (μm) and the volumetric efficiency (%) at the cylinder bore 1a or 2a of the compressor, and FIG. 5-b shows the relationships $D_1$, $D_2$, and $D_3$ between the average spacing $\bar{L}$ (μm) and the noise level (dB). (Note: The volumetric efficiency is a ratio of the .volume of the gas as discharged, per one cycle of one cylinder measured in the standard state, to the volume of the compression chamber.) These curves $C_1$, $C_2$, and $C_3$, $D_1$, $D_2$, and $D_3$, together with the curves $C_4$ and $C_5$ are obtained under the conditions wherein the rotational speed of the compressor is 1000 r.p.m., the outlet pressure of the gas at the outlet chamber is 15 kg/cm$^2$, and the inlet pressure at the inlet chamber is 2 kg/cm$^2$. The curves $C_1$ and $D_1$ show the volumetric efficiency and the noise level, respectively, when the surface roughness $\bar{R}_z$ is 10 μm, the curves $C_2$ and $D_2$ show the volumetric efficiency and the noise level, respectively, when the surface roughness $\bar{R}_z$ is 20 μm, and the curves $C_3$ and $D_3$ show the volumetric efficiency and the noise level, respectively, when the surface roughness $\bar{R}_z$ is 25 μm. As will be understood from the curves $C_1$, $C_2$, and $C_3$, the value of the volumetric efficiency is lowered when the value the average spacing $\bar{L}$ is increased to a value of 100 μm. As will be understood from the curves $D_1$, $D_2$, and $D_3$, the value of the noise level is increased of when the value the average spacing $\bar{L}$ is reduced to a value of 50 μm. Namely, the preferable range of the value of the average spacing $\bar{L}$ is between 50 μm and 100 μm.

Figure 6A:
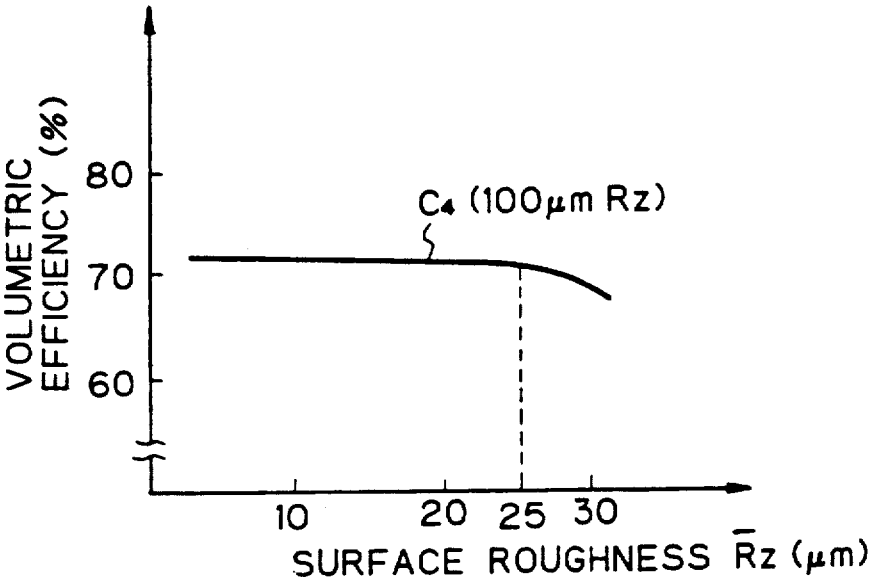
FIG. 6-a shows the relationships between the surface roughness and the volumetric efficiency.
Figure 6B:
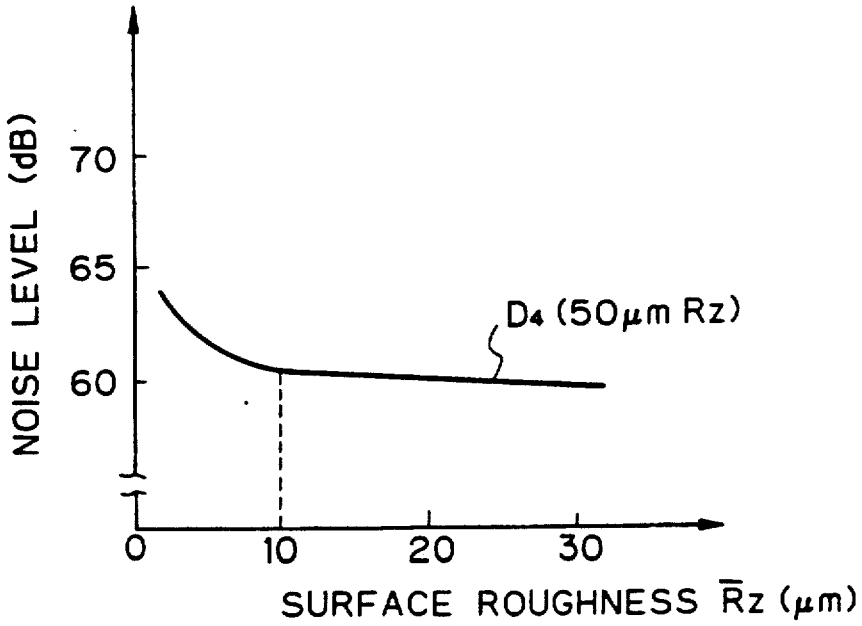

FIG. 6-a shows a relationship $C_4$ between the surface roughness $\bar{R}_z$ (μm) and the volumetric efficiency (%) at the cylinder bore 1a or 2a of the compressor. The curve $C_4$ is obtained when the average spacing $\bar{L}$ is maintained at the upper limit value 100 μm in the above-mentioned preferable range (50 μm $\leqq \bar{L} \leqq$ 100 μm). As will be understood, the volumetric efficiency is reduced when the mean depth $\bar{R}_z$ is higher that the value 25 μm. As is obvious, when the value of the average spacing $\bar{L}$ is smaller than the upper limit value 100 μm in the preferable range thereof (50 μm $\leqq \bar{L} \leqq$ 100 μm), the resistance of the gas to the leakage between the outlet valve forming plates 15 and 16 and valve port plates 8 and 12, respectively, which are adhered to each other, is automatically increased, and thus volumetric efficiency values larger than that obtained from the curve $C_4$ will be obtained.

FIG. 6-b shows a relationship $D_4$ between the surface roughness $\bar{R}_z$ (μm) and the noise level (dB) when the average spacing $\bar{L}$ is maintained at the lower limit value of 50 μm in the above-mentioned preferable range (50 μm $\leqq \bar{L} \leqq$ 100 μm). As will be understood, when the value of the surface roughness $\bar{R}_z$ (μm) is lower than the value of 10 μm, the noise level is increased. As is also obvious, when the value of the average spacing $\bar{L}$ is larger than the lower limit value 50 μm in the preferable range thereof (50 μm $\leqq \bar{L} \leqq$ 100 μm), the passage of the gas into the gaps between the outlet valve forming plates 15 and 16 and valve port plates 8 and 12, respectively, which are adhered to each other, is eased, and thus noise level values lower than that obtained from the curve $D_4$ will be obtained. Namely, as is clear from the curves, preferably the surface roughness $\bar{R}_z$ (μm) is maintained at a value of between 10 μm and 25 μm.

As clear from the above, according to the present invention, the roughened surface areas S on the surface of the valve port forming plates 8 and 12 facing the outlet valve forming plates 15 and 16 around the outlet port 8b and 12b are provided, and the surface roughness $\bar{R}_z$ of the area S is between 10 μm and 25 μm and an average spacing $\bar{L}$ is between 50 μm and 100 μm, and therefore, a lower noise level is obtained without a lowering of the volumetric efficiency.

Figures 7A, 7B, 7C:
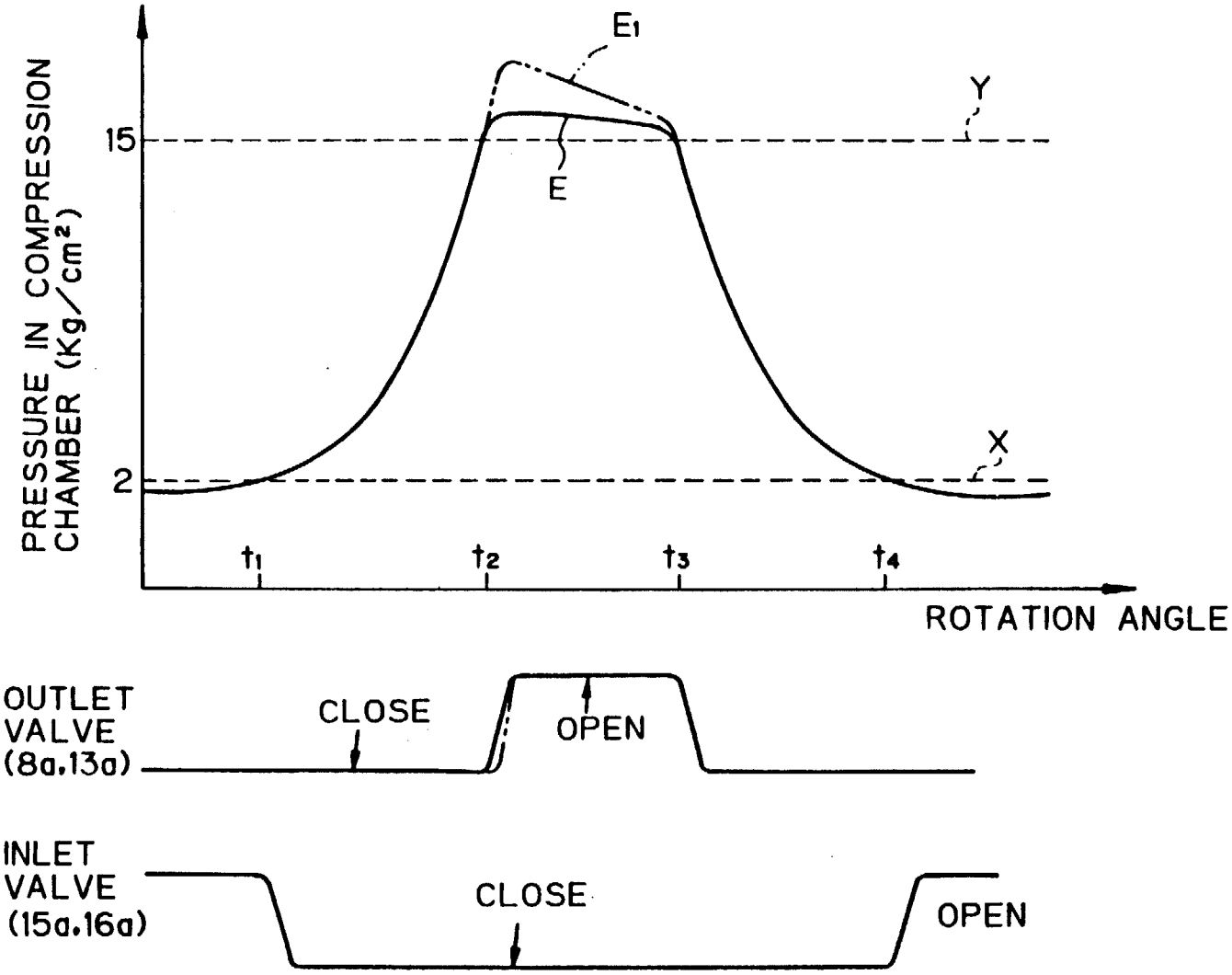
FIG. 7-(a) shows a relationship between the rotation angles of the drive shaft and the pressure, during one complete cycle of the compressor operation.

FIG. 7 shows the relationship between the angle of rotation of the drive shaft 58 and the pressure in the compression chambers 68a or 68b, during one complete cycle of the compressor operation. During the movement of each of the pistons 5 in a direction by which the volume of the compression chambers 68a and 68b is reduced, at a time t1 the pressure in the chambers 68a and 68b exceeds the first level X (the pressure at the inlet ports 8a or 12a), and thus the inlet valves 9a and 13a close the inlet ports 8a and 12a, respectively. As the piston approaches dead center, the pressure in the chambers 68a and 68b is increased, and at a time t2, the pressure therein exceeds a second level Y (the pressure at the outlet ports 8b or 12b) plus the adhesive force due to the lubricant between the inlet valves 9a and 13a and the valve port plates 8 and 12, and thus outlet valves 15a and 16a are opened to discharge the compressed gas into the outlet chambers 7b and 11b. After reaching dead center, the movement of the pistons 5 is reversed, and at a time t3, the pressure in the compression chambers 68a or 68b becomes lower than Y, and thus the valves 15a and 16a are closed. Then at time t4, the pressure becomes lower than X, and thus the inlet valves 9a and 13a open the inlet ports 8a and 12a to admit air to be compressed into the chambers 68a and 68b from the inlet chambers 7a and 11a. A curve E is obtained by the construction of the present invention, wherein the roughened surface areas S are provided on the valve port plate 8, 12 on the surface facing the outlet valve forming plate 15 and 16 around the outlet ports 8b and 12b. A dotted curve E1 is obtained when the prior art construction is employed, wherein there is no provision of the roughened areas S, so that a large adhesive force opposing the opening of the inlet valves 15a and 16a is generated, and thus the pressure in the compression chambers 68a and 68b becomes greater than that in the outlet ports 8b and 12b, respectively. An over compression is defined as a state wherein the pressure is larger than the outlet pressure Y (15 kg/cm$^2$), thus as easily seen, the prior art $E_1$ provides a large amount of over compression. This over compression is repeated by the succession of compression cycles, between the adjacent cylinders, and thus a large amount of noise is generated in the prior art. According to the present invention, as will be seen from the curve E, the degree of the over compression is suppressed by the provision of the roughened areas S, and therefore, the generation of noise is reduced.

Figure 8:
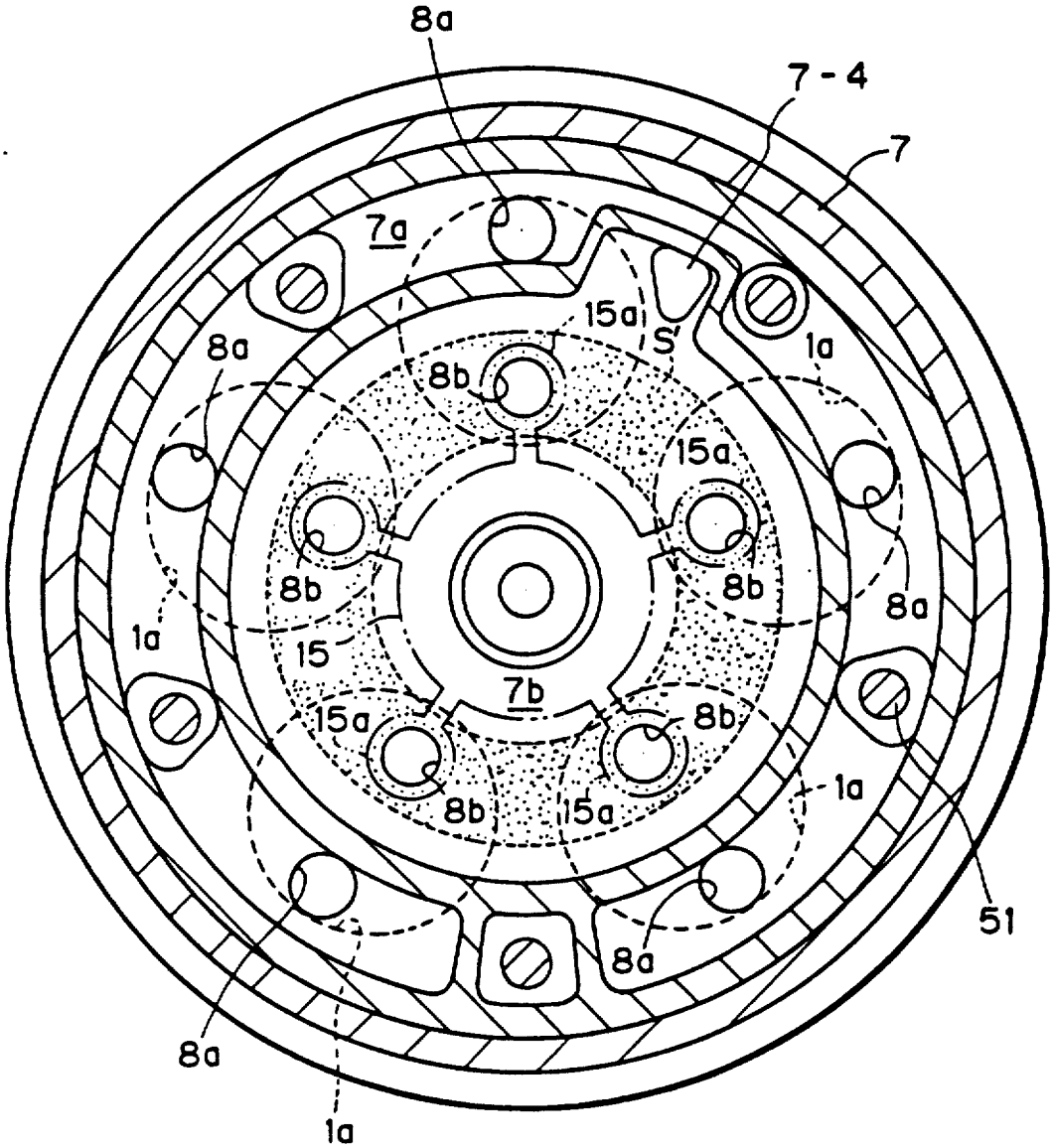
FIG. 8 is similar to FIG. 2, but shows a second embodiment of the present invention.

FIG. 8 shows a modification wherein a complete annular region S', roughened in the same way as in the first embodiment, is provided on the valve port plates facing the outlet valves 15a so that the region S' includes all of the area around the outlet ports 8b brought into contact with the corresponding outlet valves. The same annular roughened areas are provided for the valve port plate 12. The annular area S' is made such that it does not cause a problem of a leakage of the gas between the low pressure region and the high pressure region of the compressor.

Instead of the shot blasting, another process, such as grinding or knurling can be employed to obtain the roughened areas S on the valve port plate around the valve ports.

The arrangement of an outside inlet chamber and inside inlet chamber can be reversed. Furthermore, the present invention can be utilized for a compressor wherein an antivibration steel plate is mounted on the valve port plate to reduce the force of the contact between the outlet valve and the valve port plate. Finally, the present invention can be applied to any type of piston compressor, such as a wobble plate type compressor.

We claim:

1. A compressor comprising:

an axially extending drive shaft;

a pair of axially spaced apart means for rotatably supporting said drive shaft;

a cylinder block defining therein angularly spaced apart, axially extending cylinder bores;

pistons axially and slidably arranged in the respective cylinder bores;

means for mechanically connecting the drive shaft with the pistons so that the rotational movement of the drive shaft is transformed into an axial reciprocating movement of the pistons;

at least one valve port plate axially spaced apart and forming parallel first and second surfaces extending transverse to the axis of the drive shaft, the valve port plate being arranged on one side of the cylinder block so that compression chambers are formed between the respective pistons and the valve port plate in such a manner that the volumes of the compression chambers are changed by the reciprocation of the respective piston in the respective cylinder bores;

the valve port plate defining an inlet port and an outlet port for each respective compression chambers;

an inlet chamber and an outlet chamber on the side of the valve port plate remote from the pistons, the inlet chamber and the outlet chamber being separated from each other, the inlet chamber receiving gas to be compressed, via the respective inlet ports, and the outlet chamber discharging compressed gas via the respective outlet ports;

inlet valves formed as thin resilient web member arranged on the side of the valve port plate adjacent to the respective pistons, the inlet valves being urged under their own resiliency toward respective positions at which they are in contact with the faced surface of the valve port plate, to thereby close the respective inlet ports, the inlet valve being deflected from said closed position by a lowering of pressure in the respective compression chambers, to thereby allow gas to be compressed to be fed from the inlet chamber to the respective compression chambers, and;

outlet valves formed as a thin resilient web member arranged on the opposite side of the valve port plate remote from the respective pistons, the outlet valves being urged under their own resiliency toward respective positions at which they are in contact with the faced surface of the valve port plate, to thereby close the respective outlet ports, the outlet valve being deflected from said closed position by an increase of the pressure in the respective compression chambers, to thereby allow compressed gas to be discharged from the respective compression chambers to the outlet chamber;

the valve port plate having roughened areas on the surface facing the outlet valves around the respective outlet ports, said roughened areas having a surface roughness value $\overline{R}_z$ of between 10 μm and 25 μm, and having an average spacing value $\overline{L}$ of between 50 μm and 100 μm.

2. A compressor according to claim 1, wherein each of said roughened areas forms a ring-shaped area only around the corresponding inlet port.

3. A compressor according to claim 1, wherein said roughened areas extend along an entire annular region about the axis of the drive shaft.

* * * * *